United States Patent [19]

Uetake et al.

[11] Patent Number: 5,001,794

[45] Date of Patent: Mar. 26, 1991

[54] DEVICE FOR SECURING DETACHABLY FILTERING SHEET TO AIR BED

[75] Inventors: Tsuyoshi Uetake; Iwao Ueno, both of Tokyo, Japan

[73] Assignee: Keisei Medical Industrial Co., Ltd., Tokyo, Japan

[21] Appl. No.: 461,299

[22] Filed: Jan. 5, 1990

Related U.S. Application Data

[63] Continuation-in-part of Ser. No. 157,030, Feb. 18, 1988, Pat. No. 4,916,767.

[30] Foreign Application Priority Data

Feb. 21, 1987 [JP] Japan ..... 62-24657

[51] Int. Cl.[5] ..... A47G 9/04

[52] U.S. Cl. ..... 5/498; 5/508; 5/453

[58] Field of Search ..... 5/508, 496, 498, 460, 5/453, 449; 24/77.5, 306, 442, 462; 160/382, 383, 384, 385, 398, 399, 404

[56] References Cited

U.S. PATENT DOCUMENTS

| | | | |
|---|---|---|---|
| 3,658,107 | 4/1972 | Perina | 24/306 |
| 4,231,141 | 11/1980 | Derrick et al. | 24/462 |
| 4,498,205 | 2/1985 | Hino | 5/498 |
| 4,564,965 | 1/1986 | Goodwin | 5/453 |
| 4,662,016 | 5/1987 | Seeman | 5/508 |
| 4,768,250 | 9/1988 | Kato | 5/453 |

FOREIGN PATENT DOCUMENTS

| | | | |
|---|---|---|---|
| 54-128196 | 10/1979 | Japan . | |
| 58-108832 | 7/1983 | Japan . | |
| 1161406 | 8/1962 | United Kingdom | 24/306 |

*Primary Examiner*—Eric K. Nicholson

*Attorney, Agent, or Firm*—Peter J. Georges

[57] ABSTRACT

A device for securing detachably a filtering sheet to an air bed, which includes a bed body, having an upper peripheral edge defining an opening, and a number of fine solid particles contained in the bed body, has a flange secured to the upper peripheral edge of the bed body, a hook tape secured to an upper surface of the flange, a loop tape secured to a lower surface of a periphery of the filtering sheet, and a cover resiliently clamped on the flange. The filtering sheet can be firmly secured in an airtight manner to the flange in an easily removable manner by engagement between the hook tape and the loop tape.

2 Claims, 2 Drawing Sheets

DEVICE FOR SECURING DETACHABLY FILTERING SHEET TO AIR BED

CROSS-REFERENCE TO RELATED APPLICATION

This application is a continuation-in-part of U.S. patent application Ser. No. 07/157,030 filed on Feb. 18, 1988, now U.S. Pat. No. 4,916,767.

BACKGROUND OF THE INVENTION

1. Field of the Invention

The present invention relates to a device for detachably securing a filtering sheet to an air bed using fine solid particles. In such an air bed, the sheet serves to prevent the particles from spreading out of the bed, while the air can pass through the filtering sheet.

2. Description of the Related Art

The air bed of the kind mentioned above has been known and is disclosed in Japanese Patent Publication No. 54-128,196 and Japanese Utility Model No. 58-108,832. The bed comprises a bed body, a large number of ceramic beads arranged in the bed body, a filtering sheet provided to cover an opening in the bed body, and means for supplying an air stream from a bottom plate of the bed body. The air stream serves to move or agitate the ceramic particles. Due to the movement of the particles and the air stream passing through the filtering sheet, a patient lying on the sheet is floated to some extent. Therefore, the pressure applied to the patient is made uniform, so that the pain of the patient can be mitigated to a large extent and a curing effect can be promoted. Due to the above-mentioned merits, air beds have been utilized in hospitals mainly for burnt patients and very sick patients. The filtering sheet of the air bed is made from strong synthetic fibers and is placed on the mass of the solid ceramic particles in a slightly loose manner, but the periphery of the filtering sheet is fixed to a flange of the bed in an airtight manner in order to prevent the particles from being blown out of the bed by the air stream.

Patients do not lay directly on the filtering sheet, but conventional bed sheets belonging to respective patients are placed on the filtering sheet to prevent the filtering sheet from becoming stained and soiled. Furthermore, an old filtering sheet will not perform the filtering function very well, so that such an old filtering sheet has to be replaced by a new one. Therefore, the filtering sheet is detachably secured to the air bed.

In Japanese Patent Publication No. 54-128,196, there is disclosed a device for detachably securing the filtering sheet to the air bed. However, this known device utilizes a joint having a special construction, so that the operation for either removing or securing the filtering sheet either from or to the air bed is rather cumbersome. Furthermore, it is difficult to attain the complete airtight coupling required between the filtering sheet and the air bed.

SUMMARY OF THE INVENTION

The present invention has for its object to provide a novel and useful device for detachably securing a filtering sheet to an air bed in an easy manner. Also, the filtering sheet can be connected to the air bed in an airtight manner.

According to the invention, a device for detachably securing a filtering sheet to the air bed including a bed body, having an upper edge defining an opening, and solid particles contained in the bed body, comprises a flange fixed to the upper edge of the bed body; a cover detachably secured to the flange, while a periphery of the filtering sheet is clamped between the flange and the cover; and a face fastener having a hook tape and a loop tape, one of which is secured to the flange and the other of which is secured to a lower surface of the periphery of the filtering sheet.

DESCRIPTION OF THE PREFERRED EMBODIMENTS

Figure 1:
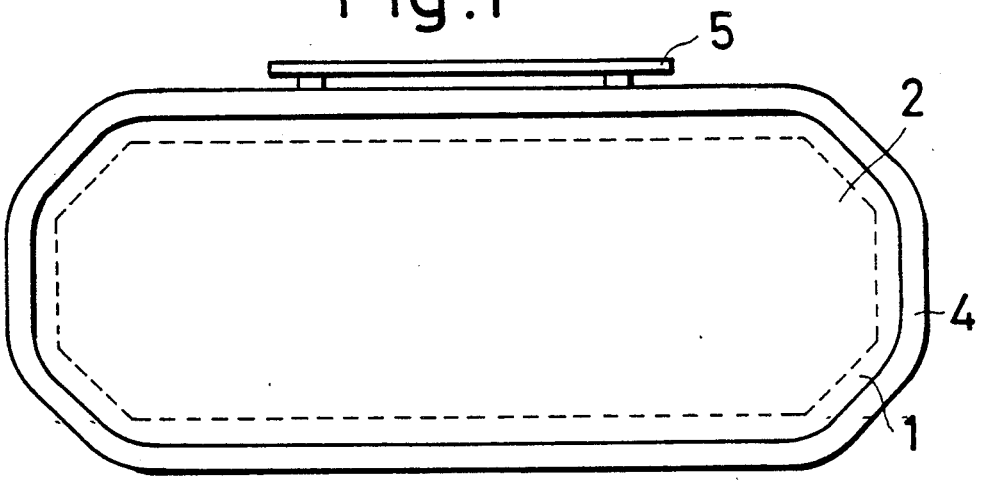
FIG. 1 is a plan view showing an embodiment of the air bed having the filtering sheet securing device according to the invention.
Figure 2:
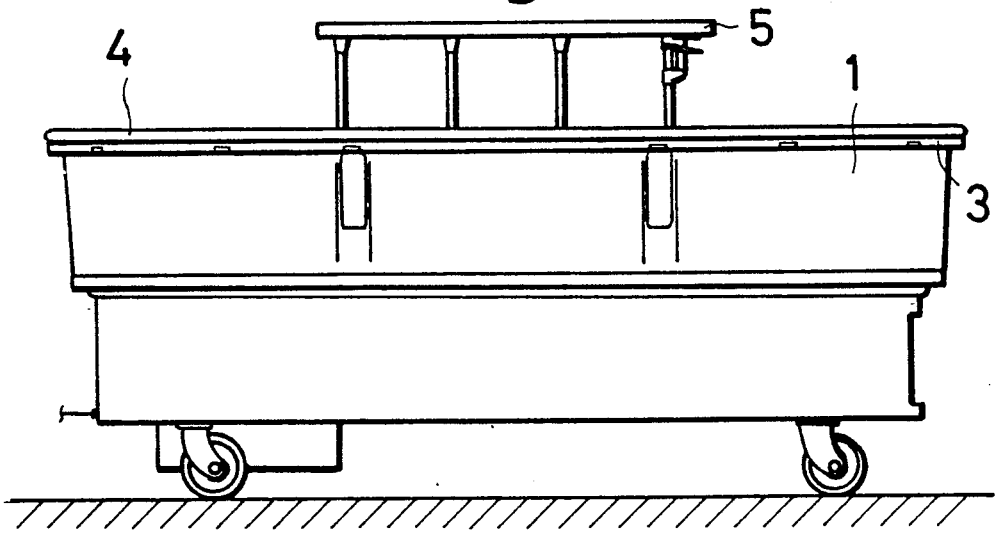
FIG. 2 is a side view illustrating the air bed shown in FIG. 1.
Figure 3:
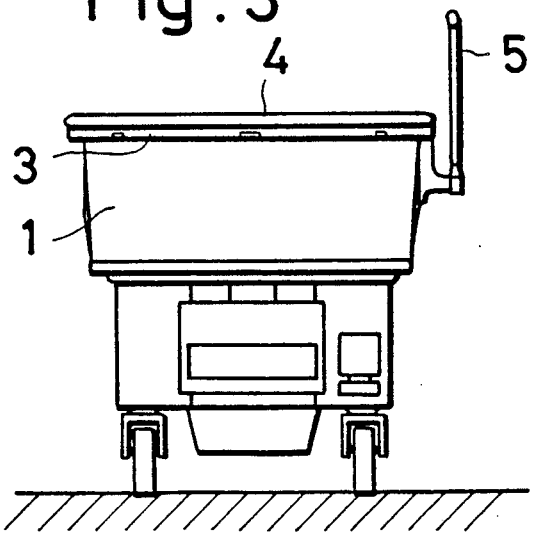
FIG. 3 is a front view depicting the air bed shown in FIG. 1.

FIGS. 1, 2 and 3 are plan, side and front views, respectively, showing the air bed having the filtering sheet securing device according to the invention. The air bed comprises a bed body 1 having a generally box-like configuration. A large number of fine solid ceramic particles are contained in the bed body 1. The opening of the bed body 1 is covered with a filtering sheet 2. The filtering sheet 2 is detachably secured to a flange 3 provided on an upper edge of the bed body 1 in such a manner that the periphery of the filtering sheet 2 is clamped between the flange 3 and a cover 4. This cover 4 is made of resilient material such as rubber and is clamped on the flange 3. There is further provided a handrail 5 fixed to the bed body 1. The filtering sheet 2 is secured to the flange 3 such that the filtering sheet 2 is placed over the fine solid ceramic particles in a loosened condition, but the periphery of the filtering sheet 2 is detachably secured to the flange 3 in an airtight manner by means of a face fastener, generally called a "magic" tape, having a hook tape and a loop tape.

Figure 4:
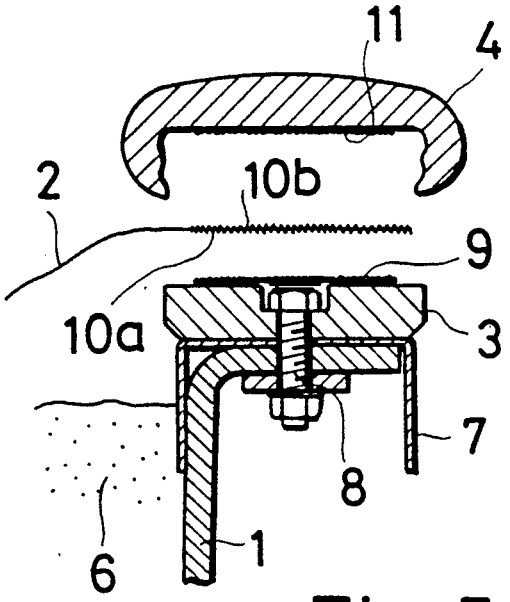
FIGS. 4(*a*) and 4(*b*) are side views showing an embodiment of the filtering sheet securing device according to the invention.
Figure 4B:
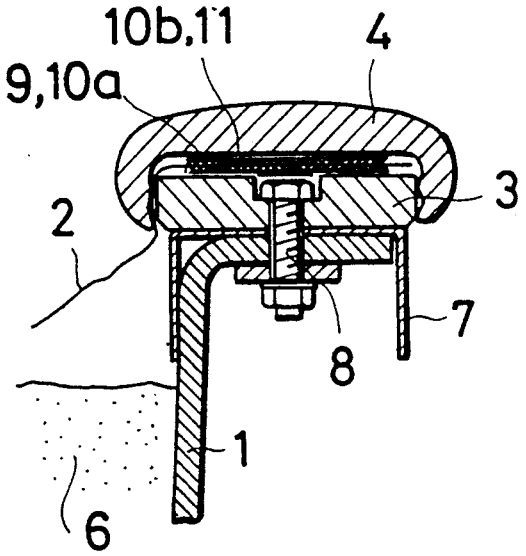

FIGS. 4(*a*) and 4(*b*) are cross-sectional views showing a first embodiment of the filtering sheet securing device according to the invention. In the bed body 1, there are contained fine solid ceramic particles 6. The flange 3 is secured to an upper edge of the bed body 1 via a frame 7 with the aid of bolts 8. On an upper surface of the flange 3, there is secured a first hook tape 9 having a large number of small hooks made of rather hard synthetic fiber. The hook tape 9 may be secured to the flange 3 by means of an adhesive agent. On both surfaces of the periphery of the filtering sheet 2, there are secured two loop tapes 10*a* and 10*b* having a number of small loops made of rather soft synthetic fiber. Furthermore, on an inner surface of the cover 4, there is also secured a second hook tape 11.

As illustrated in FIG. 4(*b*), after the first loop tape 10*a* of the filtering sheet 2 has been coupled with the first hook tape 9 secured to the flange 3, the cover 4 is clamped onto the flange 3 so that the second loop tape 10*b* on the filtering sheet 2 is connected to the second hook tape 11 fixed to the cover 4. Therefore, the filtering sheet 2 can be positively clamped between the flange 3 and the cover 4 and cannot be removed therefrom, even if the filtering sheet 2 is pulled. Moreover, because the loop tape 10*a* is firmly fixed to the hook tape 9 on the flange 3, an air gap is not formed therebetween. Consequently, the particles 6 cannot be removed from the space defined by the bed body 1 and the filtering sheet 2. When it is required to replace the old filtering sheet 2 with a new one, first the cover 4 is removed from the flange 3 and then the old filtering sheet 2 is removed from the flange 3. This operation can be performed very easily without using any particular tool, because the exchanging operation can be effected manually in an easy and prompt manner.

Figure 5:
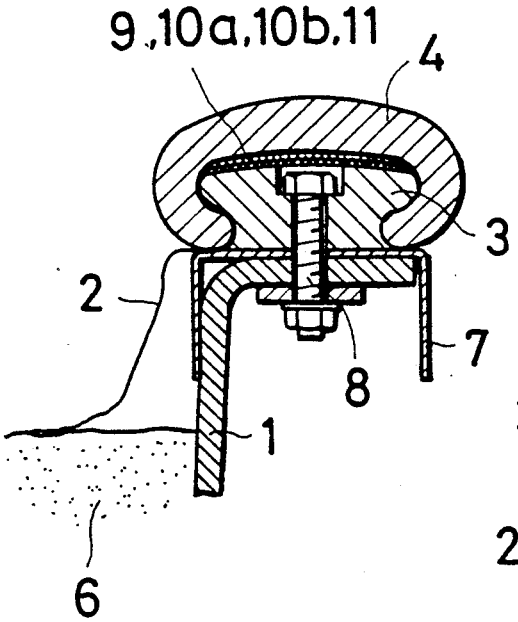
FIG. 5 is a cross-sectional view illustrating another embodiment of the filtering sheet securing device according to the invention.

FIG. 5 is a cross-sectional view illustrating another embodiment of the filtering sheet securing device according to the invention. In the present embodiment, the flange 3 is fixed to a periphery of the bed body 1 by bolts 8 and has curved recesses into which curved side edges of the cover 4 are resiliently clamped. Therefore, the filtering sheet 2 is firmly clamped between the flange 3 and the cover 4 along the entire curved or whole nonlinear boundary surfaces thereof, so that the filtering sheet 2 cannot be pulled out.

Figure 6:
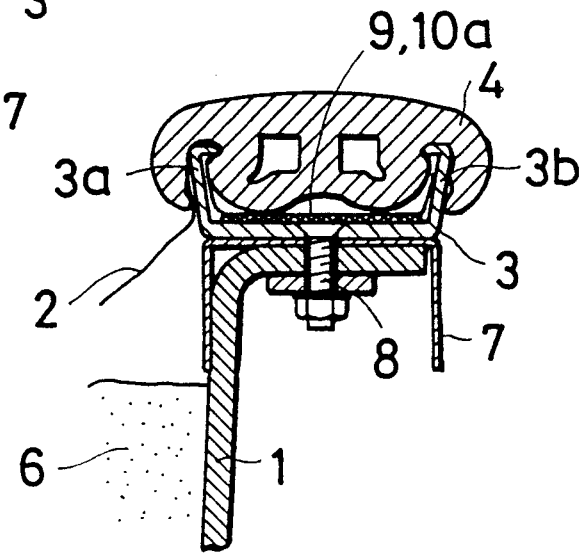
FIG. 6 is a cross-sectional view showing still another embodiment of the filtering sheet securing device according to the invention.

FIG. 6 is a cross-sectional view illustrating still another embodiment of the filtering sheet securing device according to the invention. In this embodiment, the flange 3 is formed by a channel member having upright sides 3*a* and 3*b*, and the cover 4 has recesses into which the upright side edges 3*a* and 3*b* are inserted when the cover 4 is clamped on the flange 3. In this embodiment, the second loop tape 10*b* fixed to an upper surface of the filtering sheet 2 and the second hook tape 11 secured to the cover 4 are omitted.

It should be noted that the present invention is not limited to the embodiments explained above, but many modifications and alternatives may be conceived within the scope of the invention by those skilled in the pertinent art. For instance, in the last embodiment, the first hook tape 9 is fixed to the flange 3 and the first loop tape 10*a* is secured to the filtering sheet 2, but the first loop tape 10*a* may be secured to the flange 3 and the first hook tape 9 may be fixed to the filtering sheet 2.

As explained above, in the filtering sheet securing device according to the invention, since the face fastener is provided along the whole periphery of the filtering sheet 2, the filtering sheet 2 can be fixed to the flange 3 along the whole periphery thereof without producing any space or air gap therebetween. Furthermore, since the filtering sheet 2 is firmly clamped between the flange 3 and the cover 4, the filtering sheet 2 cannot be removed therefrom. Moreover, since the cover 4 is clamped to the flange 3, due to the resiliency of the cover 4, there is not required any coupling means, such as bolts 8 extending through the filtering sheet 2, and the filtering sheet 2 can be changed manually in an easy and prompt manner without using any particular tool.

Nevertheless, for any alternative embodiment, the scope of the present invention is considered within the appended claims.

What we claim as our invention is:

1. A device for securing detachably a filtering sheet to an air bed including a bed body, having an upper edge defining an opening, and solid particles contained in the bed body, comprising:

a flange being fixed to the upper edge of the bed body and having two sides;

a cover having two side edges made of resilient material and being detachably clamped onto the flange, while a periphery of the filtering sheet is clamped between nonlinear boundary surfaces of the flange and the cover; and a face fastener having a hook tape and a loop tape, one of which is secured to the flange and the other of which is secured to a lower surface of the periphery of the filtering sheet;

wherein the flange has curved recesses formed in the two sides, and the cover has curved projections formed in the two side edges, said curved projections of the cover being clamped into the curved recesses of the flange without producing a space therebetween.

2. A device for securing detachably a filtering sheet to an air bed including a bed body, having an upper edge defining an opening, and solid particles contained in the bed body, comprising:

a flange being fixed to the upper edge of the bed body and having two sides;

a cover having two side edges made of resilient material and being detachably clamped onto the flange, while a periphery of the filtering sheet is clamped between nonlinear boundary surfaces of the flange and the cover; and a face fastener having a hook tape and a loop tape, one of which is secured to the flange and the other of which is secured to a lower surface of the periphery of the filtering sheet;

wherein the flange has upright projections facing inwardly towards each other and being formed on the two sides while the cover has recesses formed in the two side edges, said inwardly facing upright projections of the flange being clamped into the recesses of the cover and retaining the cover on the flange.

* * * * *